US009993060B2

(12) United States Patent
Hwang

(10) Patent No.: US 9,993,060 B2
(45) Date of Patent: Jun. 12, 2018

(54) COSMETIC CONTAINER HAVING DUAL CONTENTS

(71) Applicant: F.S. KOREA INDUSTRIES INC., Seoul (KR)

(72) Inventor: Jae Kwang Hwang, Seoul (KR)

(73) Assignee: F.S.KOREA INDUSTRIES INC., Dobong-Ro, Gangbuk-Gu, Seoul (KR)

( * ) Notice: Subject to any disclaimer, the term of this patent is extended or adjusted under 35 U.S.C. 154(b) by 0 days. days.

(21) Appl. No.: 14/903,280

(22) PCT Filed: Jun. 17, 2014

(86) PCT No.: PCT/KR2014/005317

§ 371 (c)(1),
(2) Date: Jan. 6, 2016

(87) PCT Pub. No.: WO2015/034165

PCT Pub. Date: Mar. 12, 2015

(65) Prior Publication Data

US 2016/0166046 A1 Jun. 16, 2016

(30) Foreign Application Priority Data

Sep. 4, 2013 (KR) ..... 10-2013-0106339

(51) Int. Cl.
*A45D 34/06* (2006.01)
*B65D 81/32* (2006.01)

(52) U.S. Cl.
CPC ..... *A45D 34/06* (2013.01); *B65D 81/3255* (2013.01); *A45D 2200/058* (2013.01)

(58) Field of Classification Search
CPC ..... A45D 34/06; A45D 34/042; A45D 2200/058; B65D 81/3255; B65D 81/3211; B65D 1/06; B65D 51/2807
USPC ..... 220/504, 516, 503
See application file for complete search history.

(56) References Cited

U.S. PATENT DOCUMENTS 4,858,759 A * 8/1989 Mauthe ..... B01F 13/002 206/219
5,143,211 A * 9/1992 Miczka ..... B65D 81/3255 206/219
5,884,759 A * 3/1999 Gueret ..... B65D 51/2835 206/219
2013/0112314 A1* 5/2013 Lee ..... A45D 34/04 141/23

FOREIGN PATENT DOCUMENTS

KR 20-0362397 Y1 9/2004
KR 10-2012-0054715 A 5/2012
KR 10-2012-0140563 12/2012
KR 10-1301917 B1 8/2013

* cited by examiner

*Primary Examiner* — Anthony Stashick
*Assistant Examiner* — Robert Poon
(74) *Attorney, Agent, or Firm* — Heedong Chae; Lucem, PC

(57) ABSTRACT

The present invention provides a cosmetic container having dual contents, in which first and second materials are separated, but the second material is discharged into the container body 10 and mixed with the first material by a user in use. Accordingly, it is possible to prevent the second material that is sensitive to external environments from being exposed to the outside until a user uses it.

5 Claims, 15 Drawing Sheets

COSMETIC CONTAINER HAVING DUAL CONTENTS

CROSS-REFERENCE TO RELATED APPLICATION

This application claims the benefit of Korean Application No. 10-2013-0106339, filed on Sep. 4, 2013 with the Korean Intellectual Property Office, the disclosure of which is incorporated herein by reference.

BACKGROUND OF THE INVENTION

1. Field of the Invention

The present invention relates to a cosmetic container having dual contents and more particularly, to a cosmetic container having dual contents which can separately keep different components before use, but can mix the components when it is opened.

2. Description of the Related Art

In general, cosmetics keep a raw material including various mixed effective components in a container and discharge a necessary amount in use.

Herein, functional cosmetics mostly use function raw materials that are powerful for wrinkle reduction and skin whitening such as vitamins and natural extracts and these raw materials have very unstable properties, so if they are mixed with a base material in advance, they easily acidify and deteriorate in an unstable state.

In particular, functional cosmetics have shorter available periods than common cosmetics and mostly use vitamins or natural extracts as raw materials, but when the natural extracts are brought in contact with air or exposed to ultraviolet rays, they easily acidify or deteriorate, so the available period further decreases.

[Prior Art Document]

[Patent Document]

Korean Utility Model Registration No. 20-0348004

SUMMARY OF THE INVENTION

An object of the Present invention is to provide a cosmetic container having dual contents that separately keeps different components before use and mixes the components when it is opened.

According to an aspect of the present invention, a cosmetic container having dual contents includes: a container body keeping a first material; and a pipette assembly combined with the container body, having a storage space for keeping a second material therein from the outside, including a piston, which presses the second material in the storage space into the container body when being operated by a user, and allowing the discharged second material and the first material to be mixed in the container body.

The pipette assembly may include a pipette communicating with the storage space and inserted in the container body, and a cap is coupled to an end of the pipette disposed in the container body.

When the pipette assembly is separated from the container body, the cap and the pipette may be separated.

A body holder that locks the cap may be formed in the container body.

The pipette assembly may include: pipette body keeping the second material; a pipette combined with the pipette body, inserted in the container body, and guiding the second material into the container body; a piston combined with the pipette body and pressing the second material; and a pressing member combined with the piston and supplying negative pressure or positive pressure to the pipette.

The container body and the pipette assembly may have a body thread and a pipette thread, respectively, to be thread-fastened to each other.

The pipette assembly may be configured such that the piston presses the second material by moving straight down.

The pipette assembly may be configured such that the piston presses the second material by rotating down.

The container body may include: a container housing keeping the first material, having open upper and lower ends, and combined with the pipette assembly; a stripper coupled to the container housing, receiving the pipette, and having a body holder so that they cap is separated when the pipette is separated; and a container base receiving the stripper and combined with the container housing to close the lower end Of the container housing.

The pipette assembly may include: a pipette body keeping the second material and thread-fastened to the container body; a pipette combined with the pipette body, inserted in the container body, and guiding the second material into the container body; and a piston combined with the pipette body and pressing the second material to the pipette.

The pipette body may include: a pipette inner cap thread-fastened to the container body; a pipette housing disposed through the pipette inner cap, combined with the pipette, and keeping the second material; and a pipette outer cap surrounding and fixing the pipette inner cap and the pipette housing.

The piston may include: a piston member closing the pipette housing, a piston holder combined with the piston member; a pressing member combined with the piston holder and supplying positive pressure or negative pressure to the pipette; and a pressure channel communicating with the pressing member and transmitting pressure to the pipette through the piston holder and the piston member.

According to another aspect of the present invention, a cosmetic container having dual contents includes: a container body keeping a first material; and a pipette assembly combined with the container body, having a storage space for keeping a second material therein from the outside, including a piston, which presses the second material in the storage space into the container body when being operated by a user, and allowing the discharged second material and the first material to be mixed in the container body, in which the pipette assembly includes: a pipette body keeping the second material and thread-fastened to the container body; a pipette combined with the pipette body, inserted in the container body, and guiding the second material into the container body; a piston combined with the pipette body and pressing the second material to the pipette; and a cap coupled to an end of the pipette and preventing the second material from flowing into the container body, and in which the container body includes: a container housing keeping the first material, having open upper and lower ends, and combined with the pipette assembly; a stripper coupled to the container housing, receiving the pipette, and having a body holder so that the cap is separated when the pipette is separated; and a container base receiving the stripper and combined with the container housing to close the lower end of the container housing.

The present invention provides a cosmetic container having dual contents, in which first and second materials are separated, but the second material is discharged into the container body 10 and mixed with the first material by a user in use. Accordingly, is possible to prevent the second material that is sensitive to external environments from being exposed to the outside until a user uses it.

Further, according to the present invention, since the second material that is easily acidified or deteriorated by external environments before a user uses is kept in the pipette assembly 20, the available period for the user is maximally increased.

Further, according to the present invention, when the pipette assembly 20 is separated from the container body 10, the cap 30 is separated in the container body 10 and the separated cap is kept in the container body 10, so a user does not need to touch the cap 30 to separate the cap 30 from the pipette 24, and accordingly, contamination of the pipette 24 is prevented.

DETAILED DESCRIPTION OF THE PREFERRED EMBODIMENTS

Figure 1:
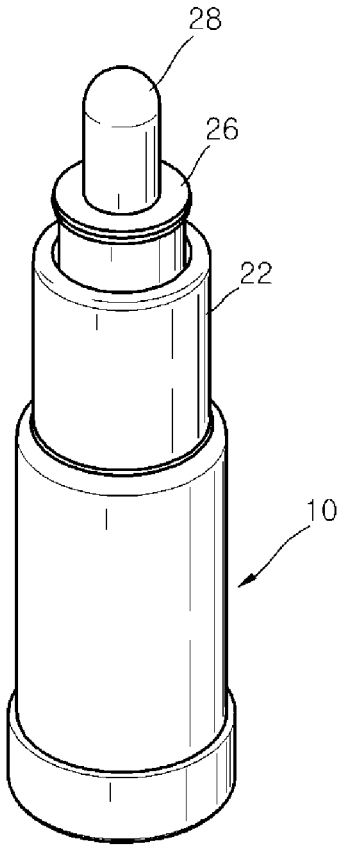
FIG. 1 is a perspective view of a cosmetic container having dual contents according to a first embodiment of the present invention.

Hereinafter, the present invention will be described in detail with reference to the accompanying drawings.

In describing the present invention, well-known functions or constructions will not be described in derail since they may unnecessarily obscure the understanding of the present invention. It should be noted that even if the same terms are used but they indicate different components, they are not given the same reference numerals.

The terms described hereafter are terms defined in consideration of the functions in the present disclosure and may be change in accordance with the intention of a user such as an experimenter and a measurer and a custom, so the definition Should be based on the entire description of the present disclosure.

Terms used in the specification, 'first', 'second', etc., may be used to describe various components, but the components are not to be construed as being limited to the term. The terms are used to distinguish one component from another component. For example, the 'first' component may be named the 'second' component, and vice versa, without departing from the scope of the present invention. The term 'and/or' includes a combination of a plurality of items or any one of a plurality of terms. Terms used in the present specification are used only in order to describe specific exemplary embodiments rather than limiting the present invention.

As used herein, the singular forms are intended to include the plural forms as well, unless the context clearly indicates otherwise.

Unless otherwise defined, all terms including technical and scientific terms used herein have the same meaning as commonly understood by one of ordinary skill in the art to which the present invention belongs. It must be understood that the terms defined by the dictionary are identical with the meanings within the context of the related art, and they should not be ideally or excessively formally defined unless the context clearly dictates otherwise.

Further, unless explicitly described otherwise, "comprising" any components will be understood to imply the inclusion of other components rather than the exclusion of any other components.

Figure 2:
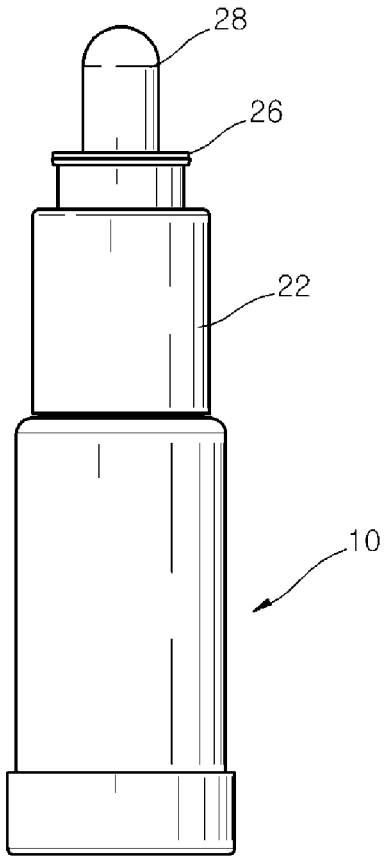
FIG. 2 is a front view of FIG. 1.
Figure 3:
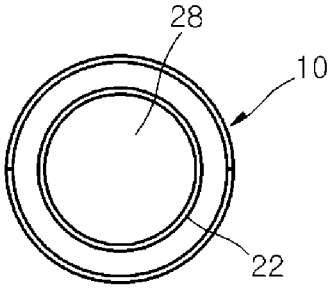
FIG. 3 is a plan view of FIG. 1.
Figure 4:
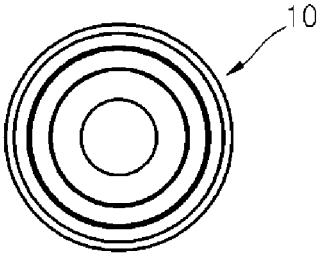
FIG. 4 is a bottom view of FIG. 1.
Figure 5:
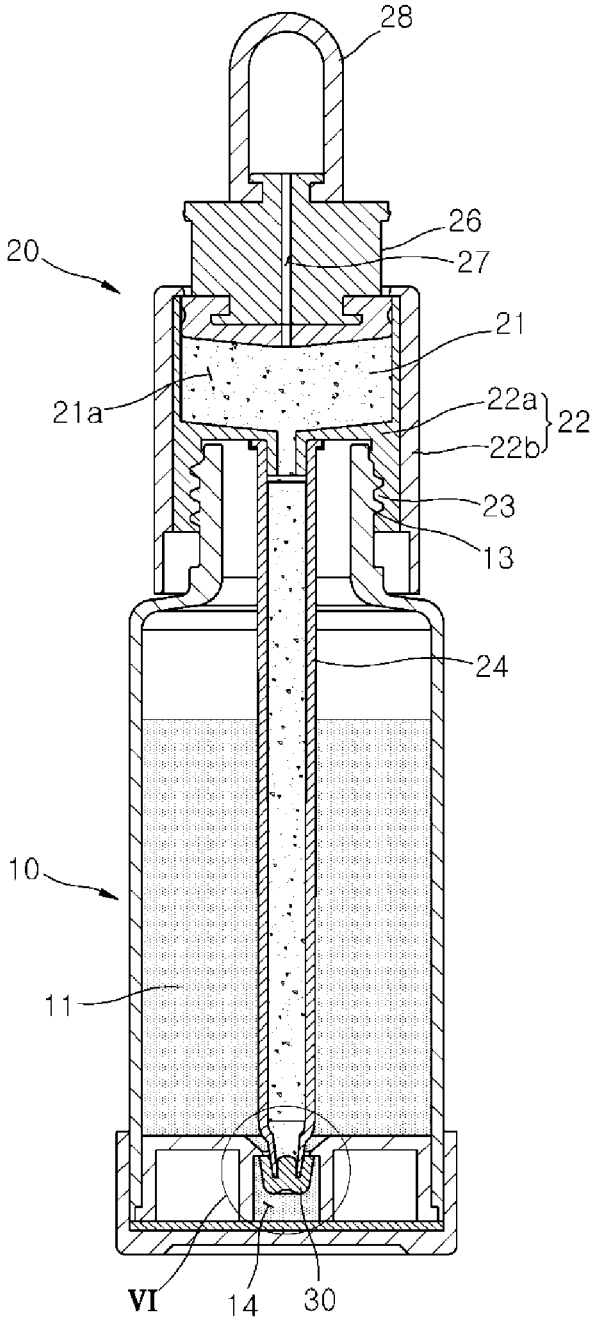
FIG. 5 is a cross-sectional view taken along line A-A of FIG 2.
Figure 6:
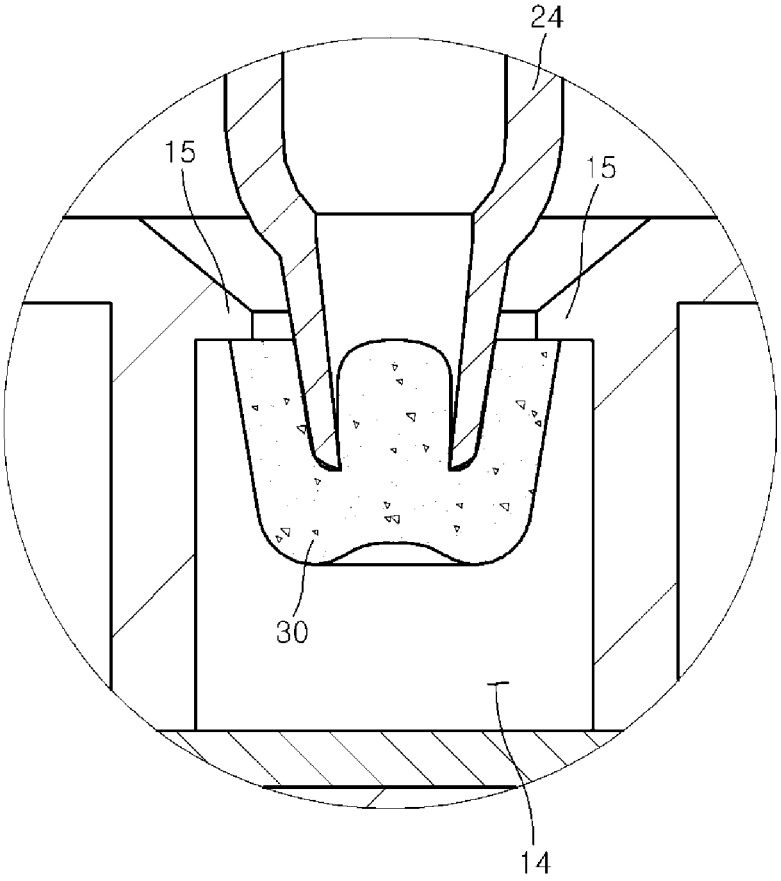
FIG. 6 is an enlarged view of the portion B in FIG. 2.
Figure 7:
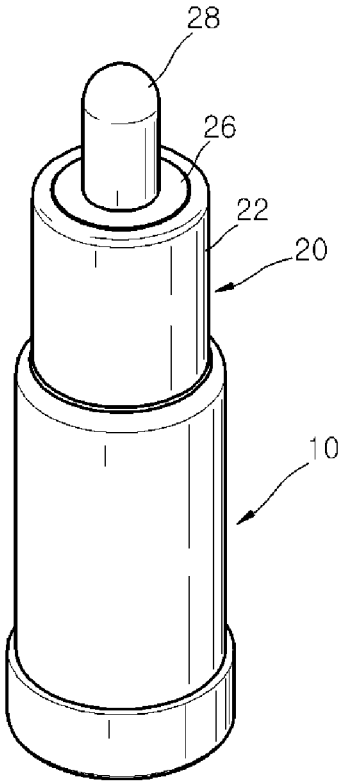
FIG. 7 is a perspective view illustrating operation of the cosmetic container illustrated in FIG. 1.
Figure 8:
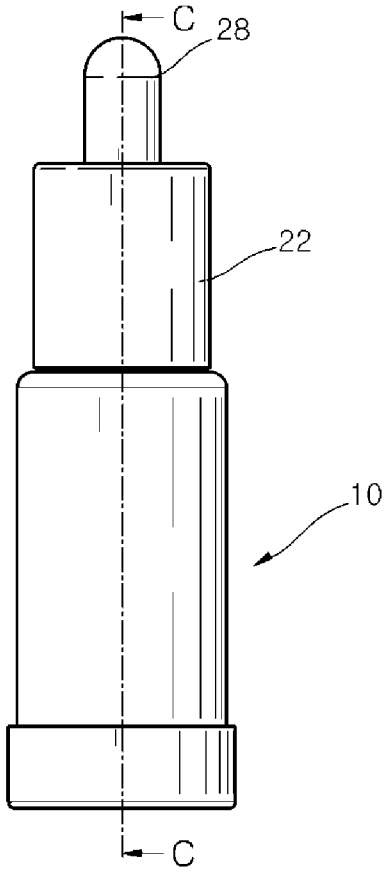
FIG. 8 is a front view of FIG. 7.
Figure 9:
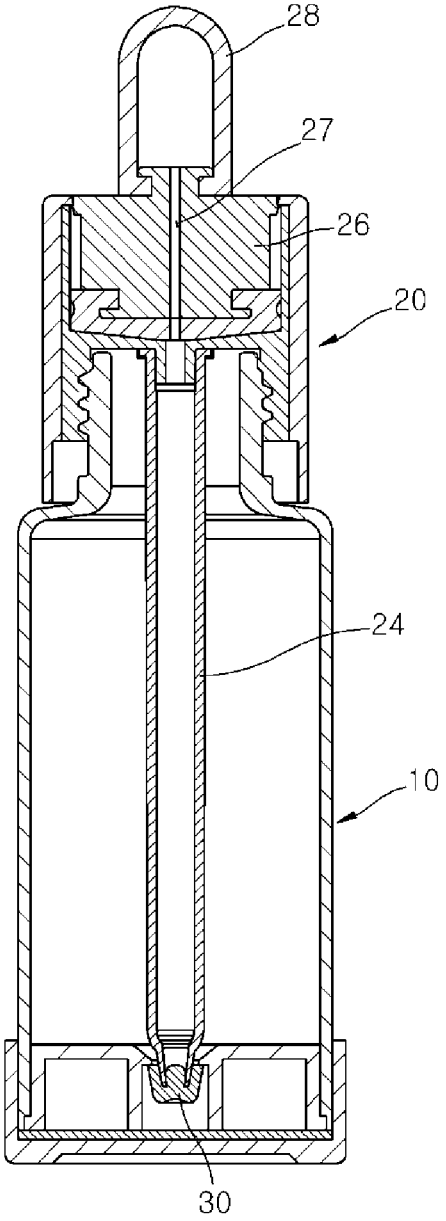
FIG. 9 is a cross-sectional view taken along line C-C of FIG. 8.
Figures 10A, 10B, 10C:
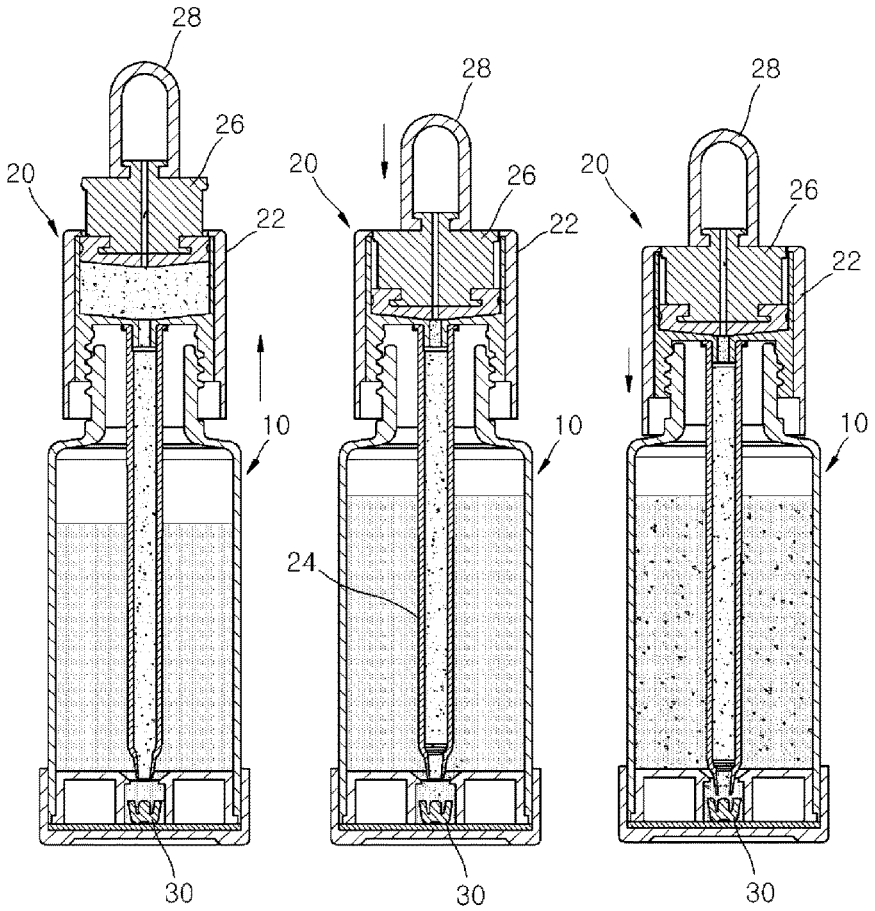
FIGS. 10A, 10B and 10C are exemplary views illustrating an operation example of FIG. 5.

FIG. 1 is a perspective view of a cosmetic container having dual contents according to a first embodiment of the present invention, FIG. 2 is a front view of FIG. 1, FIG. 3 is a plan view of FIG. 1, FIG. 4 is a bottom view of FIG. 1, FIG. 5 is a cross-sectional view taken along line A-A of FIG. 2, FIG. 6 is an enlarged view of the portion B in FIG. 2, FIG. 7 is a perspective view illustrating operation of the cosmetic container illustrated in FIG. 1, FIG. 8 is a front view of FIG. 7, FIG. 9 is a cross-sectional view taken along line C-C of FIG. 8, and FIG. 10 is an exemplary view illustrating an operation example of FIG. 5.

As illustrated in the figures, a cosmetic container having dual contents according to an embodiment of the present invention separately keeps two kinds of make-ups before use, and mixes them when it opens.

To this end, the cosmetic container includes a container body 10 keeping a first material 11 and a pipette assembly 20 combined with the container body 10 and keeping a second material 21.

The container body 10 has an opening at the top and a body thread 13 around the outer surface the upper portion.

A cap hole 14 where a cap 30 that will be described below and a body holder 15 where the cap 30 is fitted to be locked are formed inside the container body 10.

The pipette assembly 20 includes a pipette body 22 keeping the second material a pipette thread 23 formed around the inner side of the pipette body 22, a pipette 24 combined with the pipette body 22, inserted in the container body 10, and guiding the second material 21 into the container body 10, a piston 26 combined with the pipette body 22 and pressing the second material 21, and a pressing member 28 combined with the piston 26 and supplying negative pressure or positive pressure to the pipette 24.

The pipette body 22 is composed of an inner body 22*a* having the pipette thread 23 and an outer body 22*b* disposed outside the inner body 22*a*, but unlike this embodiment, the inner body 22*a* and the outer body may be integrally formed.

In particular, a storage space for keeping the second material 21 is formed in inner body 22*a*.

The pipette body 22 may be made of a material that is opaque or reflects light to block light such as the ultraviolet rays traveling to the storage space 21*a*, so deterioration such as acidification of the second material 21 in the storage space 21*a* is prevented.

The pipette 24 is formed in a pipe shape with the upper end communicating with the storage space 21*a* of the inner body 22*a* and the lower end inside the container body 10. In this embodiment, the lower end of the pipette 24 is inserted in the cap hole 14.

The piston 26 combined with the pipette body 22 moves toward the storage space 21*a*, and in this process, the second material 21 in the storage space 21*a* presses and discharges the second material 21 to the pipette 24.

Herein, a pressure channel 27 that communicates with the pressing member 28 is formed in the piston 26, so a pressure change by the pressing member 28 can be transmitted to the pipette 24.

The pressing member 28 is made of elastic rubber in this embodiment and can supply negative pressure or positive pressure to the pipette 24 when being operated by a user.

In this embodiment, the piston 26 discharges the second material 21 to the pipette 24 by moving along the inner body 22*a* when being operated by a user, but unlike this embodiment, the piston 26 may be rotated with respect to the pipette body 22 to discharge the second material 21 to the pipette 24.

That is, thread may be formed on the inner side of the inner body 22*a* to rotate the piston 26 along the thread such that the second material 21 is discharged to the pipette 24 by rotation of the piston 26.

Further projections, may be formed with predetermined intervals on the inner side of the inner body 22*a* to lock the piston 26 so that the second material 21 can be discharged in a predetermined amount by a user.

Meanwhile, the cap 30 is coupled to the lower end of the pipette 24 to prevent the second material 21 from flowing into the container body 10.

Herein, the cap 30 is combined with the pipette 24 and inserted in the cap hole 14, and when the pipette assembly 20 is separated from the container body 10, the cap 30 and the pipette 24 are separated.

Operation of the cosmetic container for dual contents according to a first embodiment of the present invention is described in detail with reference to the drawings.

First, the second material 21 is in the storage space 21*a* of the pipette assembly 20 and the cap 30 is coupled to the lower end of the pipette 24 to prevent leakage of the second material 21.

With the cap 30 coupled to the pipette assembly 20, the pipette 24 is inserted in the container body 10, and the pipette assembly 20 and the container body 10 are thread-fastened.

In this process, the cap 30 is inserted into the cap hole 14, in detail, passes the body holder 15 and is positioned under the body holder 15.

Thereafter, when a user separates the pipette assembly 20 from the container body 10 by turning it, the pipette assembly 20 is moved up and the cap 30 and the body holder 15 are locked to each other, in which the cap 30 is separated from the pipette assembly 20.

Accordingly, the lower end of the pipette 24 is opened with the cap 30 left in the cap hole 14.

Thereafter, when the user presses the piston 26 exposed over the pipette body 22 toward the storage space 21*a*, the second material 21 in the storage space 21*a* is discharged into the container body 10 by the piston 26 pressed down.

The discharged second material 21 is moved down in the container body 10 and mixed with the first material 11, in which the first and second materials 11 and 21 may make a chemical reaction, depending on their properties.

After the first and second materials 11 and 21 are mixed, the user moves the mixture into the pipette 24 by operating the pressing member 28 and then takes out the pipette 24 from the container body 10, so the user can use the mixture in the pipette 24 in a desired amount.

After using the pipette assembly 20, the user couples the pipette assembly 20 back to the container body 10 by turning it, so the lower end of the pipette 24 is inserted into the cap hole 14, but is not coupled to the cap 30.

Meanwhile, although the container body 10 and the pipette assembly 20 are thread-fastened in this embodiment, unlike this embodiment, they may be fitted to each other in a one-touch type by being moved up/down, so the coupling way of the container body 10 and the pipette assembly 20 may be implemented in various ways by those skilled in the art.

Figure 11:
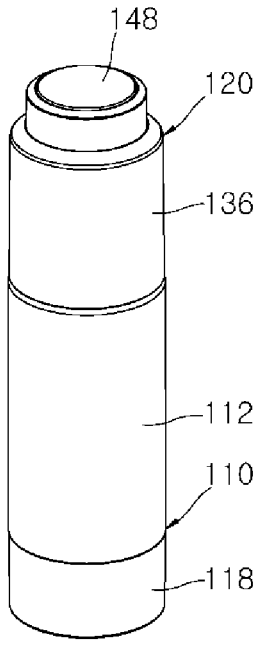
FIG. 11 is a perspective view of a cosmetic container having dual contents according to a second embodiment of the present invention.
Figure 12:
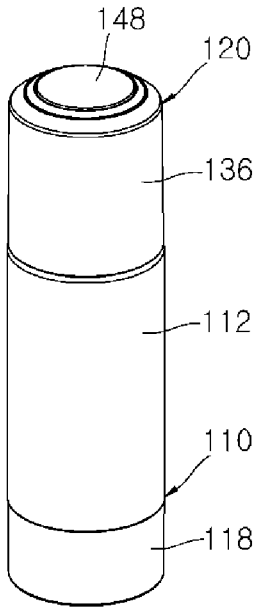
FIG. 12 is an exemplary view illustrating operation of FIG. 11.
Figure 13:
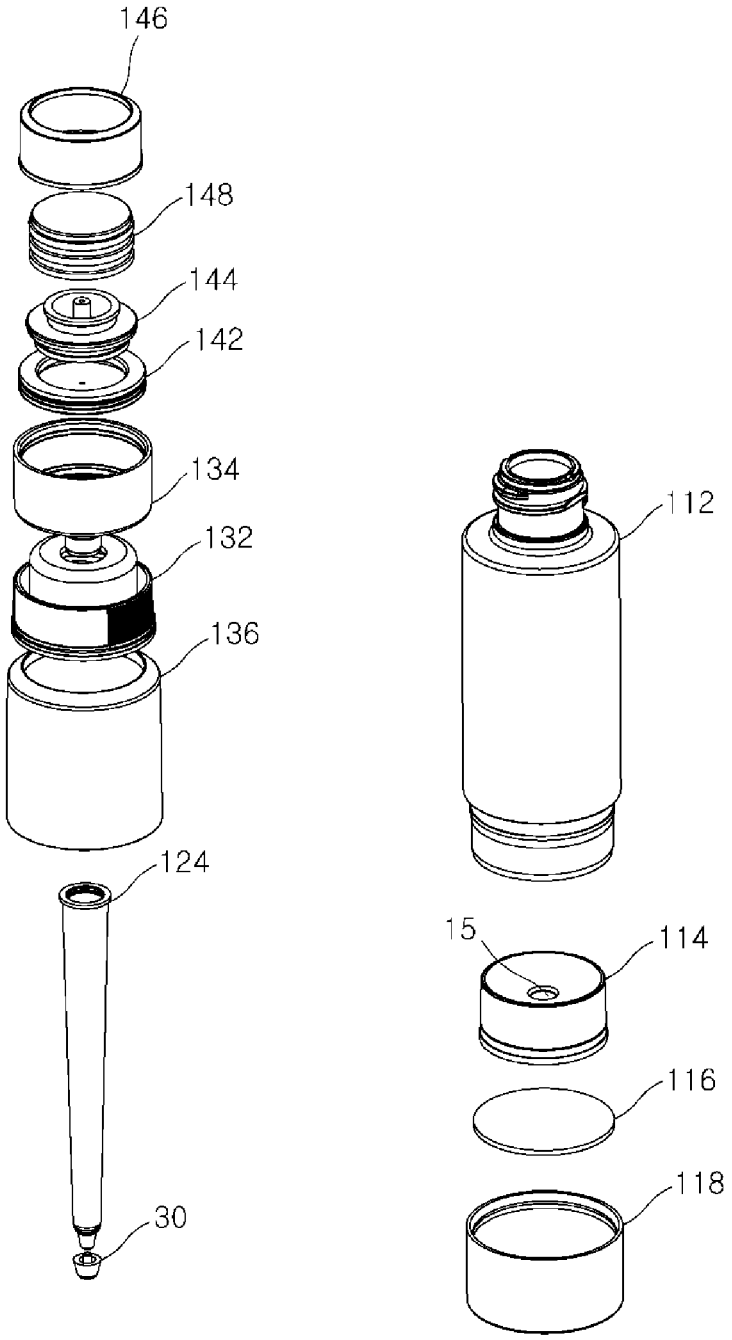
FIG. 13 is an exploded perspective view of FIG. 11.
Figure 14:
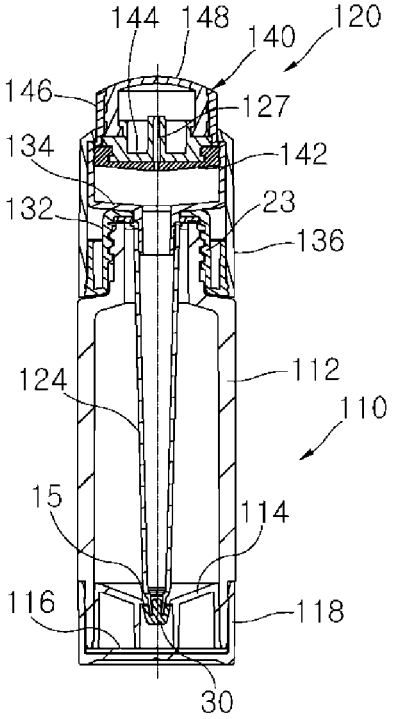
FIG. 14 is a front cross-sectional view of FIG. 11.
Figure 15:
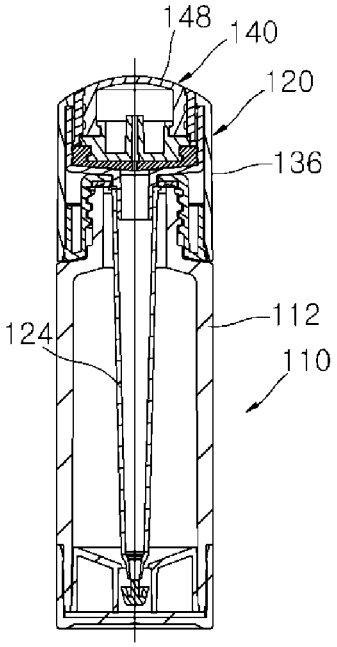
FIG. 15 is a front cross-sectional view of FIG. 12.

FIG. 11 is a perspective view of a cosmetic container having dual contents according to a second embodiment of the present invention, FIG. 12 is an exemplary view illustrating operation of FIG. 11, FIG. 13 is an exploded perspective view of FIG. 11 , FIG. 14 is a front cross-sectional view of FIG. 11, and FIG. 15 is a front cross-sectional view of FIG. 12.

The cosmetic container having dual contents according to this embodiment is operated in the same principle as the first embodiment, but includes different components from the first embodiment.

The cosmetic container having dual contents includes a container body 110 keeping a first material and a pipette assembly 120 combined with the container body 110 and keeping a second material 21.

The container body 110 includes: a container housing 112 keeping the first material, having open upper and lower ends, and having a body thread 13 for coupling to the pipette assembly 120; a stripper 114 coupled to the lower portion of the container housing 112, receiving the pipette 124, and having a body holder 15 for separating the cap 30 when the pipette 124 is separated; a container packing 116 being in close contact with the lower portion of the stripper 114; and a container base 118 receiving the stripper 114, coupled to the lower portion of the container housing 112 to close the lower end of the container housing 112.

With the stripper 114 disposed in the container housing 112, when the pipette 120 is separated, the cap 30 is locked to the striper 114, and the separated cap 30 is left in the stripper 114.

The pipette assembly 120 includes a pipette body 130 keeping the second material and thread-fastened to the container body 110, a pipette 124 combined with the pipette body 130, inserted in the container body 110, and guiding the second material into the container body 110, and a piston 140 combined with the pipette body 130 and pressing the second material to the pipette 124.

The pipette body 130 includes a pipette inner cap 132 having a thread on the inner side and thread-fastened to the container body 110, a pipette housing 134 disposed through the pipette inner cap 132, combined with the pipette 124, and keeping the second material, and a pipette outer cap 136 surrounding and fixing the pipette inner cap 132 and the pipette housing 134.

The pipette housing 134 and the pipette outer cap 136 are open at the top so that the piston 140 is inserted.

The piston 140 includes a piston member 142 closing the pipette housing 134, a piston holder 144 combined with the piston member 142, a pressing member 148 combine with the piston holder 144 and supplying positive pressure or negative pressure to the pipette 124, a piston cover 146 surrounding the piston holder 144 and the pressing member 148, and a pressure channel 127 communicating with the pressing member 148 and transmitting pressure to the pipette 124 through the piston holder 144 and the piston member 142.

The piston member 142 presses the second material to the pipette 124 by vertically moving on the inner side of the pipette housing 134.

The piston holder 144 combines the pressing member 148 and the piston member 142.

The pressing member 148 is made of an elastic material and restored after being elastically transformed by a user.

The other configuration is the same as that of the first embodiment, so it is not described in detail.

Although exemplary embodiments of the present invention were described above with reference to the accompanying drawings, the present invention is not limited thereto and those skilled in the art would understand that the present invention may be implemented in various ways without changing the necessary features or the spirit of the prevent invention. Therefore, it should he understood that the exemplary embodiments are not limiting but illustrative in all aspects.

What is claimed is:

1. A cosmetic container having dual contents, comprising:

a container body keeping a first material; and a pipette assembly combined with the container body, the pipette assembly having a storage space for keeping a second material therein, including a piston, which presses the second material in the storage space into the container body when operated by a user, and thereby allowing discharged second material and the first material to be mixed in the container body, wherein the pipette assembly includes:

a pipette communicating with the storage space and inserted in the container body and a cap coupled to an open end of the pipette and received in a cap hole of the container body, wherein the pipette assembly is separable from the container body, wherein, when the pipette assembly is separated from the container body, the cap and the pipette are separated and the cap remains in the cap hole of the container body, wherein a body holder that locks the cap is formed in the container body, wherein the cap is inserted into the cap hole through the body holder, and wherein when a user separates the pipette assembly from the container body, the pipette assembly is moved up and the cap is pressed away from the pipette by the body holder such that the cap is separated from the pipette and the first material and the second material are mixed.

2. The cosmetic container of claim 1, wherein the pipette assembly includes:

a pipette body keeping the second material;

the pipette combined with the pipette body, inserted in the container body, and guiding the second material into the container body;

a piston combined with the pipette body and pressing the second material; and a pressing member combined with the piston and supplying negative pressure or positive pressure to the pipette.

3. The cosmetic container of claim 1, wherein the container body and the pipette assembly have a body thread and a pipette thread, respectively, to be thread-fastened to each other.

4. The cosmetic container of claim 2, wherein the pipette assembly is configured such that the piston presses the second material by moving straight down.

5. The cosmetic container of claim 1, wherein the pipette assembly is configured such that the piston presses the second material by rotating down.

* * * * *